US005928405A

United States Patent [19]

Ranade et al.

[11] Patent Number: 5,928,405

[45] Date of Patent: Jul. 27, 1999

[54] METHOD OF MAKING METALLIC POWDERS BY AEROSOL THERMOLYSIS

[75] Inventors: Madhav B. Ranade, Bethesda, Md.; Dan V. Goia, Potsdam, N.Y.; Geoffrey J. Varga, Bridgewater, N.J.; Bernard W. Gamson, Potomac, Md.; John Bara, Honolulu, Hi.

[73] Assignees: Degussa Corporation, Ridgepark, N.J.; Particle Technology, Inc., Hanover, Md.

[21] Appl. No.: 08/859,853

[22] Filed: May 21, 1997

[51] Int. Cl.[6] ..... B22F 9/24

[52] U.S. Cl. ..... 75/337; 75/338; 75/351; 75/361

[58] Field of Search ..... 75/337, 338, 351, 75/355, 361, 371

[56] References Cited

U.S. PATENT DOCUMENTS 4,023,961 5/1977 Douglas et al. ..... 75/355

5,429,657 7/1995 Glicksman et al. ..... 75/371

FOREIGN PATENT DOCUMENTS 2-54704 2/1990 Japan .

*Primary Examiner*—George Wyszomierski

*Attorney, Agent, or Firm*—Smith, Gambrell & Russell; Beveridge, DeGrandi, Weilacher & Young Intellectual Property Group

[57] ABSTRACT

An economical process and associated hardware for commercial manufacture of controllable submicrometer size metallic powders for electronic and other applications. The method is based on the preparation of a stable high concentration precursor solution, production of a high density aerosol mist of the precursor solutions, selection of mist droplets with upper and lower size bounds, controlled drying of the droplets, their conversion to metallic powder in a high temperature gaseous atmosphere and the separation of the powders from carrier gases without significant loss inside the process hardware.

13 Claims, 11 Drawing Sheets

FIG.5A - 1

| SIZE | % PASS | % CHAN | SIZE | % PASS | % CHAN | SIZE | % PASS | % CHAN | SIZE | % PASS | % CHAN |
|---|---|---|---|---|---|---|---|---|---|---|---|
| 704.0 | 100.00 | 0.00 | 80.70 | 100.00 | 0.00 | 9.250 | 100.00 | 0.00 | 1.060 | 53.95 | 7.16 |
| 645.6 | 100.00 | 0.00 | 74.00 | 100.00 | 0.00 | 8.482 | 100.00 | 0.00 | 0.972 | 46.79 | 6.23 |
| 592.0 | 100.00 | 0.00 | 67.86 | 100.00 | 0.00 | 7.778 | 100.00 | 0.00 | 0.892 | 40.56 | 5.47 |
| 542.9 | 100.00 | 0.00 | 62.23 | 100.00 | 0.00 | 7.133 | 100.00 | 0.00 | 0.818 | 35.09 | 4.91 |
| 497.8 | 100.00 | 0.00 | 57.06 | 100.00 | 0.00 | 6.541 | 100.00 | 0.00 | 0.750 | 30.18 | 4.48 |
| 456.5 | 100.00 | 0.00 | 52.33 | 100.00 | 0.00 | 5.998 | 100.00 | 0.00 | 0.688 | 25.70 | 4.17 |
| 418.6 | 100.00 | 0.00 | 47.98 | 100.00 | 0.00 | 5.500 | 100.00 | 0.00 | 0.630 | 21.53 | 3.89 |
| 383.9 | 100.00 | 0.00 | 44.00 | 100.00 | 0.00 | 5.044 | 100.00 | 0.00 | 0.578 | 17.64 | 3.62 |
| 352.0 | 100.00 | 0.00 | 40.35 | 100.00 | 0.00 | 4.625 | 100.00 | 0.00 | 0.530 | 14.02 | 3.31 |
| 322.8 | 100.00 | 0.00 | 37.00 | 100.00 | 0.00 | 4.241 | 100.00 | 0.00 | 0.486 | 10.71 | 2.98 |
| 296.0 | 100.00 | 0.00 | 33.93 | 100.00 | 0.00 | 3.889 | 100.00 | 0.00 | 0.446 | 7.73 | 2.52 |
| 271.4 | 100.00 | 0.00 | 31.11 | 100.00 | 0.00 | 3.566 | 100.00 | 0.00 | 0.409 | 5.21 | 1.92 |
| 248.9 | 100.00 | 0.00 | 28.53 | 100.00 | 0.00 | 3.270 | 100.00 | 0.00 | 0.375 | 3.29 | 1.37 |
| 228.2 | 100.00 | 0.00 | 26.16 | 100.00 | 0.00 | 2.999 | 100.00 | 0.00 | 0.344 | 1.92 | 0.81 |
| 209.3 | 100.00 | 0.00 | 23.99 | 100.00 | 0.00 | 2.750 | 100.00 | 0.00 | 0.315 | 1.11 | 0.50 |
| 191.9 | 100.00 | 0.00 | 22.00 | 100.00 | 0.00 | 2.522 | 100.00 | 0.00 | 0.289 | 0.61 | 0.38 |
| 176.0 | 100.00 | 0.00 | 20.17 | 100.00 | 0.00 | 2.312 | 100.00 | 0.26 | 0.265 | 0.23 | 0.23 |
| 161.4 | 100.00 | 0.00 | 18.50 | 100.00 | 0.00 | 2.121 | 99.74 | 0.83 | 0.243 | 0.00 | 0.00 |
| 148.0 | 100.00 | 0.00 | 16.96 | 100.00 | 0.00 | 1.945 | 98.91 | 2.04 | 0.223 | 0.00 | 0.00 |
| 135.7 | 100.00 | 0.00 | 15.56 | 100.00 | 0.00 | 1.783 | 96.87 | 3.71 | 0.204 | 0.00 | 0.00 |
| 124.5 | 100.00 | 0.00 | 14.27 | 100.00 | 0.00 | 1.635 | 93.16 | 6.13 | 0.187 | 0.00 | 0.00 |
| 114.1 | 100.00 | 0.00 | 13.08 | 100.00 | 0.00 | 1.499 | 87.03 | 7.78 | 0.172 | 0.00 | 0.00 |
| 104.7 | 100.00 | 0.00 | 12.00 | 100.00 | 0.00 | 1.375 | 79.25 | 8.61 | 0.158 | 0.00 | 0.00 |
| 95.96 | 100.00 | 0.00 | 11.00 | 100.00 | 0.00 | 1.261 | 70.64 | 8.71 | 0.145 | 0.00 | 0.00 |
| 88.00 | 100.00 | 0.00 | 10.09 | 100.00 | 0.00 | 1.156 | 61.93 | 7.98 | 0.133 | 0.00 | 0.00 |

FIG.5B - 1

| SIZE | % PASS | % CHAN | SIZE | % PASS | % CHAN | SIZE | % PASS | % CHAN | SIZE | % PASS | % CHAN |
|---|---|---|---|---|---|---|---|---|---|---|---|
| 704.0 | 100.00 | 0.00 | 80.70 | 100.00 | 0.00 | 9.250 | 100.00 | 0.00 | 1.060 | 46.73 | 5.36 |
| 645.6 | 100.00 | 0.00 | 74.00 | 100.00 | 0.00 | 8.482 | 100.00 | 0.00 | 0.972 | 41.37 | 4.97 |
| 592.0 | 100.00 | 0.00 | 67.86 | 100.00 | 0.00 | 7.778 | 100.00 | 0.00 | 0.892 | 36.40 | 4.60 |
| 542.9 | 100.00 | 0.00 | 62.23 | 100.00 | 0.00 | 7.133 | 100.00 | 0.00 | 0.818 | 31.80 | 4.26 |
| 497.8 | 100.00 | 0.00 | 57.06 | 100.00 | 0.00 | 6.541 | 100.00 | 0.13 | 0.750 | 27.54 | 3.90 |
| 456.5 | 100.00 | 0.00 | 52.33 | 100.00 | 0.00 | 5.998 | 99.87 | 0.21 | 0.688 | 23.64 | 3.50 |
| 418.6 | 100.00 | 0.00 | 47.98 | 100.00 | 0.00 | 5.500 | 99.66 | 0.27 | 0.630 | 20.14 | 3.12 |
| 383.9 | 100.00 | 0.00 | 44.00 | 100.00 | 0.00 | 5.044 | 99.39 | 0.37 | 0.578 | 17.02 | 2.73 |
| 352.0 | 100.00 | 0.00 | 40.35 | 100.00 | 0.00 | 4.625 | 99.02 | 0.48 | 0.530 | 14.29 | 2.40 |
| 322.8 | 100.00 | 0.00 | 37.00 | 100.00 | 0.00 | 4.241 | 98.54 | 0.60 | 0.486 | 11.89 | 2.15 |
| 296.0 | 100.00 | 0.00 | 33.93 | 100.00 | 0.00 | 3.889 | 97.94 | 0.71 | 0.446 | 9.74 | 1.89 |
| 271.4 | 100.00 | 0.00 | 31.11 | 100.00 | 0.00 | 3.566 | 97.23 | 0.82 | 0.409 | 7.85 | 1.63 |
| 248.9 | 100.00 | 0.00 | 28.53 | 100.00 | 0.00 | 3.270 | 96.41 | 0.95 | 0.375 | 6.22 | 1.39 |
| 228.2 | 100.00 | 0.00 | 26.16 | 100.00 | 0.00 | 2.999 | 95.46 | 1.12 | 0.344 | 4.83 | 1.19 |
| 209.3 | 100.00 | 0.00 | 23.99 | 100.00 | 0.00 | 2.750 | 94.34 | 1.36 | 0.315 | 3.64 | 1.00 |
| 191.9 | 100.00 | 0.00 | 22.00 | 100.00 | 0.00 | 2.522 | 92.98 | 1.75 | 0.289 | 2.64 | 0.80 |
| 176.0 | 100.00 | 0.00 | 20.17 | 100.00 | 0.00 | 2.312 | 91.23 | 2.31 | 0.265 | 1.84 | 0.62 |
| 161.4 | 100.00 | 0.00 | 18.50 | 100.00 | 0.00 | 2.121 | 88.92 | 3.06 | 0.243 | 1.22 | 0.47 |
| 148.0 | 100.00 | 0.00 | 16.96 | 100.00 | 0.00 | 1.945 | 85.86 | 4.01 | 0.223 | 0.75 | 0.34 |
| 135.7 | 100.00 | 0.00 | 15.56 | 100.00 | 0.00 | 1.783 | 81.85 | 4.91 | 0.204 | 0.41 | 0.26 |
| 124.5 | 100.00 | 0.00 | 14.27 | 100.00 | 0.00 | 1.635 | 76.94 | 5.75 | 0.187 | 0.15 | 0.15 |
| 114.1 | 100.00 | 0.00 | 13.08 | 100.00 | 0.00 | 1.499 | 71.19 | 6.23 | 0.172 | 0.00 | 0.00 |
| 104.7 | 100.00 | 0.00 | 12.00 | 100.00 | 0.00 | 1.375 | 64.96 | 6.31 | 0.158 | 0.00 | 0.00 |
| 95.96 | 100.00 | 0.00 | 11.00 | 100.00 | 0.00 | 1.261 | 58.65 | 6.16 | 0.145 | 0.00 | 0.00 |
| 88.00 | 100.00 | 0.00 | 10.09 | 100.00 | 0.00 | 1.156 | 52.49 | 5.76 | 0.133 | 0.00 | 0.00 |

METHOD OF MAKING METALLIC POWDERS BY AEROSOL THERMOLYSIS

INTRODUCTION AND BACKGROUND

The present invention relates to a method for producing metallic powders in micron and submicron size. The metallic powders are particularly useful for electronic applications.

Metallic powders in micron size range have many special applications including dental materials, medical prosthetics, catalysts, electronic devices such as multilayer capacitors, integrated circuits and structural applications in the aircraft industry. Purity, controlled particle size and morphology are often essential for many applications. Smooth spherical particles of palladium (Pd), silver (Ag) and palladium/silver (Pd/Ag) alloys, nickel (Ni) and gold (Au) in 0.5 to 2.0 micrometer size range are needed for multilayer capacitors. For this use, it is essential to limit the onset of oxidation to a temperature above 400°C. and at the same time the total oxidation must also be below a few percent. The presence of too many small particles (0.3 microns and smaller) is undesirable because of their high surface to volume ratio which makes them more susceptible to higher levels of oxidation. Also, particles larger than 2 microns are to be avoided so that a thin smooth layer may be printed by screen printing employing pastes made with these powders.

Particle size in the micrometer range, spherical shapes, crystallinity and purity and lack of voids in particles are essential qualities of the powders for electronic applications such as in multilayer capacitors. Spray decomposition of solution droplets of precursor compounds is an attractive process because of simple apparatus and equipment design and ability to operate in a continuous mode.

The prior art has developed a number of methods for producing small particle metal powders. For example, Nagashima et al. (*J. Material Research*, 1987) produced nickel powders by spraying nickel nitrate and chloride solutions followed by in-flight treatment at 900–1600°C. in an $H_2/N_2$ atmosphere. Temperatures above 1500° C. were necessary to obtain smooth spheres. Stopic et al. (1996)—(*I.J. of Powder Metallurgy*, Vol. 32, pp. 59–65) used long residence times of the order of 20 seconds to obtain smooth spheres at lower temperature in the range of 800–900° C. At lower temperatures, a significant amount of nickel oxide, an undesirable by-product, was observed. Although complete conversion to nickel at 900° C. was reported, crystallization was not complete. Hollow spheres were also observed.

Asada et al. (JP 62-1807, 1987) describe a method for production of powders of Ag, Pd and their alloys by decomposition of sprays at temperatures well above the melting point of the metals. Asada et al. (JP Kokai 6-172802, November 1992) mention the addition of trace quantities of calcium and similar elements in producing Pd powder resistant to oxidation.

Kodas et al. (U.S. Pat. No. 5,429,657, July 1995) disclose a method for producing powder of Pd, Ag and their alloys at temperatures significantly lower than the melting point of the metal but at long residence times of 9–20 seconds. The aerosol concentrations were limited to a value which might result in a 10% reduction in concentration by coagulation.

Glicksman et al. (U.S. Pat. No. 5,616,165, April 1997; European Application EP 0761349 A1) extended the same method as Kodas et al. (U.S. Pat. No. 5,429,657, July 1995) to producing gold (Au) powder wherein the operating temperature is below the melting point of gold.

An object of the present invention is to provide an improved method for obtaining micrometer size and submicrometer size metallic powders.

SUMMARY OF THE INVENTION

In achieving the above and other objects, the invention involves an economical process and associated equipment for commercial manufacture of controllable submicrometer size metallic powders for electronic and other applications. The method of the invention is based on the preparation of a stable high concentration precursor solution, production of a high density aerosol mist of the precursor solutions, selection of mist droplets with upper and lower size bounds, controlled drying of the droplets, their conversion to metallic powder in a high temperature gaseous atmosphere and the separation of the powders from carrier gases without significant loss inside the process equipment.

BRIEF DESCRIPTION OF THE DRAWINGS

The invention will be further understood with reference to the drawings, wherein.

DETAILED DESCRIPTION OF THE INVENTION

Figure 1:
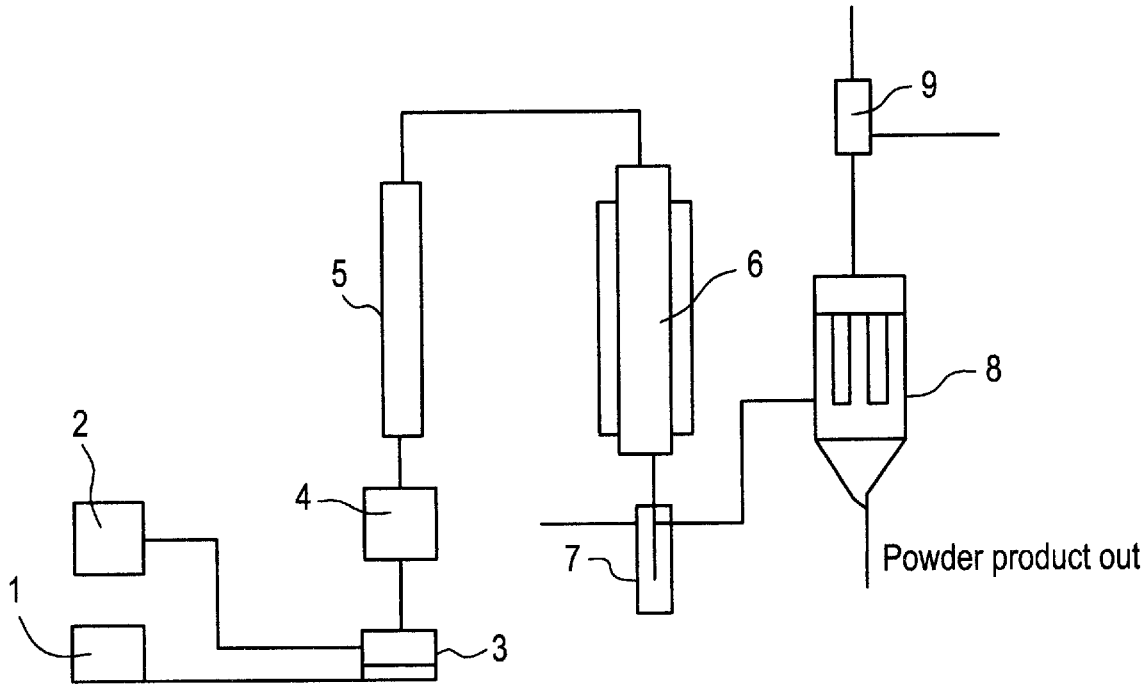
FIG. 1 is a schematic flow diagram of the process of the invention.

The process and apparatus described in this invention are especially useful for producing finely divided, spherically shaped, non-hollow, fully densified particles in the micrometer and submicrometer size ranges with selectable upper and lower size cuts. More particularly, the present invention enables the control of the nature of the final metal or metal alloy product particle so as to obtain particles with a size distribution of from about 0.3 to 2 microns. Also the invention allows commercial production at low costs because of the energy savings realized by increase in the precursor concentration, number concentration of droplets in the carrier gas and by minimization of process losses to the walls of the process vessel and piping. A schematic flow diagram of the process of the invention is shown in FIG. 1. As used herein, the term "metal" is intended to include metal alloys as well.

A stable precursor solution containing high metal concentration is desirable to achieve high product output. For silver, palladium and their mixtures, metal loadings higher than possible in simple aqueous solutions of their nitrates, are achieved using the first feature of this invention—addition of excess free nitric acid.

The high concentration precursor solution is prepared by dissolution of soluble ingredients in water or dissolution of metal in acids, rather than by dispersion of solid components.

The increase in the metal content of the solution has the direct effect of increasing the output.

The metal precursor compounds can be nitrate salts, or salts of mineral or organic acids, but metal nitrates have primarily been used. These compounds are referred to herein as thermally decomposable precursor compounds. The solutions thereof are formed in thermally volatilizable solvents.

By the term "high metal concentration", we mean a range of 5 to 35% by weight metal content. Although nitric acid is preferred other mineral acids such as hydrochloric acid can be used to form the solution provided the resulting metal precursor compound is soluble in the solvent for spraying.

Nitric acid concentration is expressed in terms of weight %, and is based on the total amount of material in the sprayed solution. Also, the total concentration of Pd metal is up to 30% There is no minimum concentration of metal in the solution, but the rate of production of metal drops as the concentration is reduced, so it is normally kept rather high for practical reasons.

As shown by the schematic flow diagram in FIG. 1, the liquid solution containing the thermally decomposable metal precursor compound is maintained in a reservoir (1) and transferred to the mist producing device (3) such as an acoustic or gas driven or a pressure atomizer. Atomizers of this nature are commercially available. An ultrasonic atomizer widely used for atomization of water for humidification purposes is very suitable for practice of the invention provided it is constructed of corrosion resistant material. Various techniques have been used to atomize the solution disclosed herein, such as two-fluid nozzles, high pressure nozzles, Collison nebulizers, filter element aerosol generators and the like. The mist producing device forms an aerosol with the carrier gas consisting essentially of finely divided droplets of the sprayed solution of the thermally decomposable metal precursor compounds in the carrier gas.

Carrier gas such as air or nitrogen as well as other gases, such as argon, hydrogen, carbon monoxide, or mixtures thereof necessary for conversion of the precursors to metal are introduced from the reservoir (2) to the mist generator (3). Mixtures of gases such as nitrogen and hydrogen as a forming gas for reduction of metals are particularly suitable. The resulting aerosol is conveyed to the particle size selector and concentrator (4) via entrainment in the carrier gas flow. After flowing through the particle size selector and concentrator (4), the mist proceeds through a controlled drying section (5). The dryer removes the solvent which, in most cases, is water thereby producing particles made up of the soluble metal salt, such as a nitrate. After drying, the aerosol flows to the reactor zone (6) for the conversion to the metallic, densified powder. The product particles are then cooled in the cooler section (7) and flow to the product collector (8). Carrier gases are scrubbed in scrubber (9) and vented or recovered, indicated by the vertical line and horizontal line, respectively.

In the reactor there is a thermal decomposition or a reaction between the particle and the gaseous component. For example, hydrogen reacts with nickel oxide formed by decomposition of nitrate.

In general, the solvent is completely removed in the drying stage in a controlled drying determined by experiment. Thus, the best control of the drying rate avoids conditions that would be so high as to form hollow shells or fragments.

Figure 2:
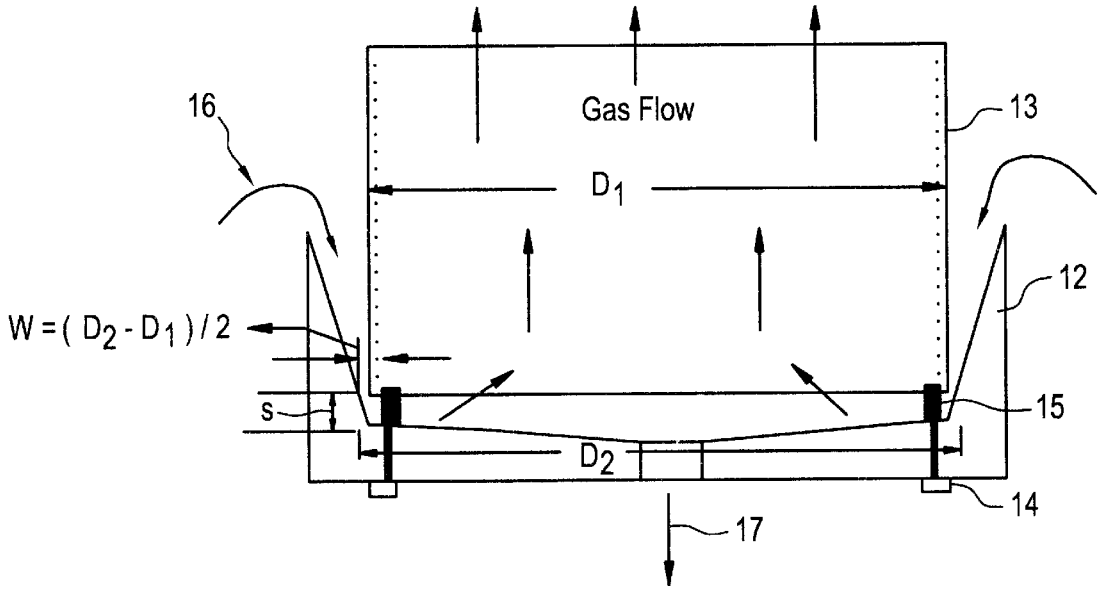
FIG. 2 is a schematic view of a large droplet separator apparatus used in the process of the invention.

The particle size selector and concentrator (4) is shown in greater detail in FIG. 2. The large particle separator consists of a machined cup (12) with internal taper of up to 60 degrees. It is attached to the base of a cylindrical tube (13) of diameter $D_1$ using screws (14) and the tube is separated from the cup by a distance 's' using spacers (15). The internal diameter of the cup at the same level as the base of the tube is $D_2$. The gap between the cup and the tube is W and is equal to $(D_2-D_1)/2$. Mist droplets larger than the desired size are removed by inertial separation causing them to collect in the cup (12) and are drained back to the mist generator (3).

The separation of particles by size is based on their inertia. A larger particle has higher mass and requires more force to change direction. In a steady stream of the mist or an aerosol (16), the particles flow with the carrier gas following the gas streamlines until there is a change in direction caused by an obstacle such as a plate or a bend in a pipe. Large particles tend to continue in the same flow direction while the gas exerts force to change the direction. As a result the larger particles lag and deviate more from the gas flow as compared to smaller particles and gas molecules.

The separation is controlled by a combination of the flow velocity, the dimension of the flow passage and the geometry of the obstacle.

The separation is effected by adjusting the characteristic opening "W" in FIG. 2 which is related to the dimensionless "Stokes Number" governing the inertial separation as follows $$\text{Stokes Number, } N_{Stk} = \frac{d_s^2 \cdot U \cdot \rho_s \cdot C_c}{18 \cdot \mu \cdot W} \quad \text{(I)}$$

where $d_s$ is droplet size in centimeters (cm.), $\mu$ is viscosity in poise, $\rho_s$ is solution density in g/cc, $C_c$ is the Cunningham slip correction=1.0 for the normal range of droplet sizes used, U is the average velocity in cm/s, and W is the characteristic opening in cm equal to $(D_2-D_1)/2$.

If "Q" is the air flow rate in liters per min., the velocity U in cm/s is related to W by the equation:

$$U \cdot \pi/4 \cdot (D_2^2 - D_1^2) = 1000 \cdot Q/60 \quad \text{(II)}$$

or for $D_2-D_1$ $$U \cdot \pi D_1 \cdot W = 1000 \cdot Q/60$$

or $$U = (1000 \cdot Q/60)\pi D_1 \cdot W$$

or, for $D_1$=15 cm(6")

U=0.353 Q/W

For an annular jet, the square root of the Critical Stokes Number $N_{Stkc}$ is of the order of 0.7 and the Design Equation for selector is $$N_{Stkc} = (0.7)^2 = 0.49 = \frac{d_{sc}^2 \cdot U \cdot \rho_s}{18 \cdot \mu \cdot W} \quad \text{III}$$

The Stokes Number "$N_{Stk}$" is a convenient way to account for all the important quantities for particle separation. In the Equation I for the Stokes Number the variable U—the velocity and W the gap determine the particle diameter at separation and the Stokes number these conditions is called the Critical Stokes Number. The other quantities, $\mu$—the viscosity and $p_s$—the solution density are generally fixed. The terms U and W are related to each other for a given flow rate as indicated by the Equation II.

Once the particle size for separation is chosen and the gas flow rate selected, the required gap width W is calculated using the Equation III. Thus, the separator can be tuned by adjusting only the gap W for the desired gas flowrate which in turn sets the production rate. In the device depicted in FIG. 2, (symbols included in the accompanying drawing) the droplet size separation may be adjusted by varying the distance 's' by addition of spacers and thus proportionately changing the gap W.

The large droplets impacting on the solid surface of the separator accumulate in the cup and flow back into the mist generator through the liquid drain (17).

Figure 3:
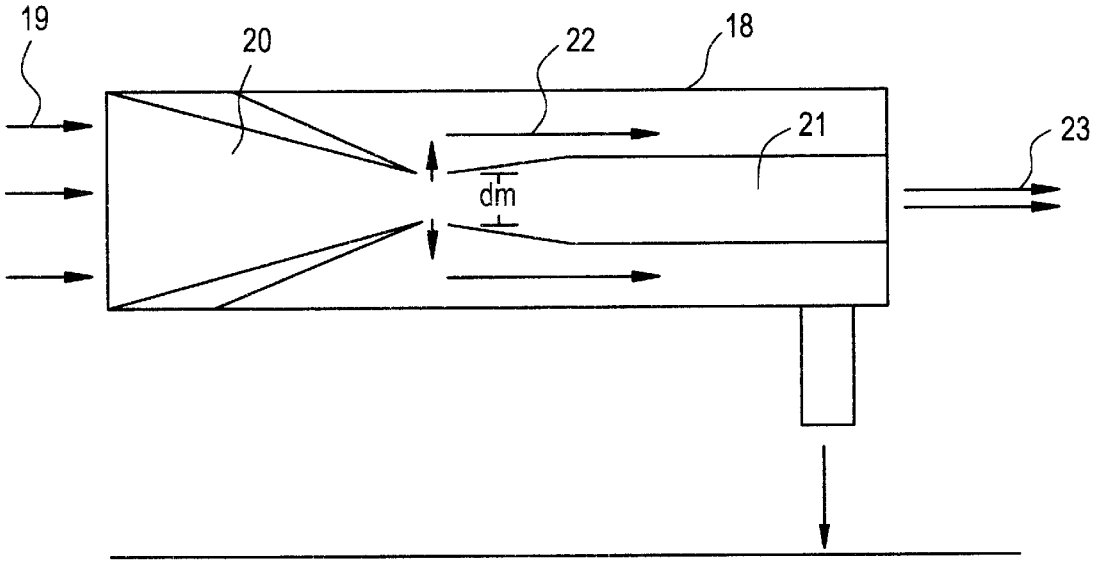
FIG. 3 is a schematic view of a small droplet remover and concentrator.

The second stage of the selector/concentrator also consists of an inertial separator. The aerosol mist flow is divided into two flows as shown in the virtual impactor (18) of FIG. 3. The virtual impactor shown in FIG. 3 is used to remove smaller particles in the second stage. The term is used in aerosol science and technology literature to represent the flow obstacle as being a stationary or slow moving gas rather than a solid surface usually used in "normal" impactors. The separation is still based on inertia. The aerosol spray (19) from the large particle separator may be concentrated, and particles smaller than 0.5 micrometers may be removed using the virtual impactor shown in FIG. 3. The aerosol flow is accelerated in the primary jet (20) of diameter $d_j$ and aimed at another jet (21), the minor flow jet, with slightly larger diameter $d_m$. The flow through this jet is maintained at only a fraction (typically 1/10th) of the total flow and is called the minor flow. The rest of the flow—the major flow (22) (typically 9/10th)—goes around the minor flow conduit (21) through the annular space. The larger particles have higher inertia and remain entrained in the minor flow. This results in an increased concentration of larger particles. The small particles remain entrained in all of the gas, and those in the major flow are removed from the aerosol stream (23) flowing to the reactor. Some smaller particles stay in the minor flow, but significant removal (typically 90%) of small particles is possible. The second stage also achieves increased droplet concentration because of the reduced amount of the carrier gas, a feature desirable to reduce the heating energy requirement.

The mist then flows through a heated tube serving as a controlled drying section (5) maintained at a minimum temperature between 50 to 150° C. and above the dew point of the flowing gas and vapor mixture. The dryer tube is heated by electric resistance heaters. Controlled drying with a residence time on the order of a second or more is essential to avoid formation of a crust of dried material which may cause formation of hollow shells or collapsed balloons or tiny fragments produced by shattering of the droplets. Proper drying residence time is achieved by trial and error through experimentation within the skill of the art. Residence time is determined by the velocity of the material flowing through the system, as well as the length of the drying section.

The dry aerosol then flows through the reactor zone (6) where conversion to the final metal product takes place. The temperature of the reactor and the residence times are controlled to yield a product containing near spherical shaped particles whose size is related to the droplet size by the following relation IV.

The reactor zone is a refractory hot-wall tube which is contained in a furnace that is heated by gas or electrically. The unidentified line coming off the cooler (7) is the cold gas injection. The cooler utilizes a porous inner tube surrounded by an air jacket.

The droplet size $d_s$ is related to the final metal particle size $d_p$ by the equation:

$$(\text{Metal Density}\cdot\pi dp^3=\rho_s\cdot\pi\cdot d_s^3) \qquad \text{IV}$$

In the first stage of the Separator (shown in FIG. 2), the mist droplets of a size such that will result in final solid particles 2 micrometers in diameter are separated. The relevant droplet size is calculated by the Equation IV by knowledge of densities and concentration of the metal in the starting solution.

Figure 4:
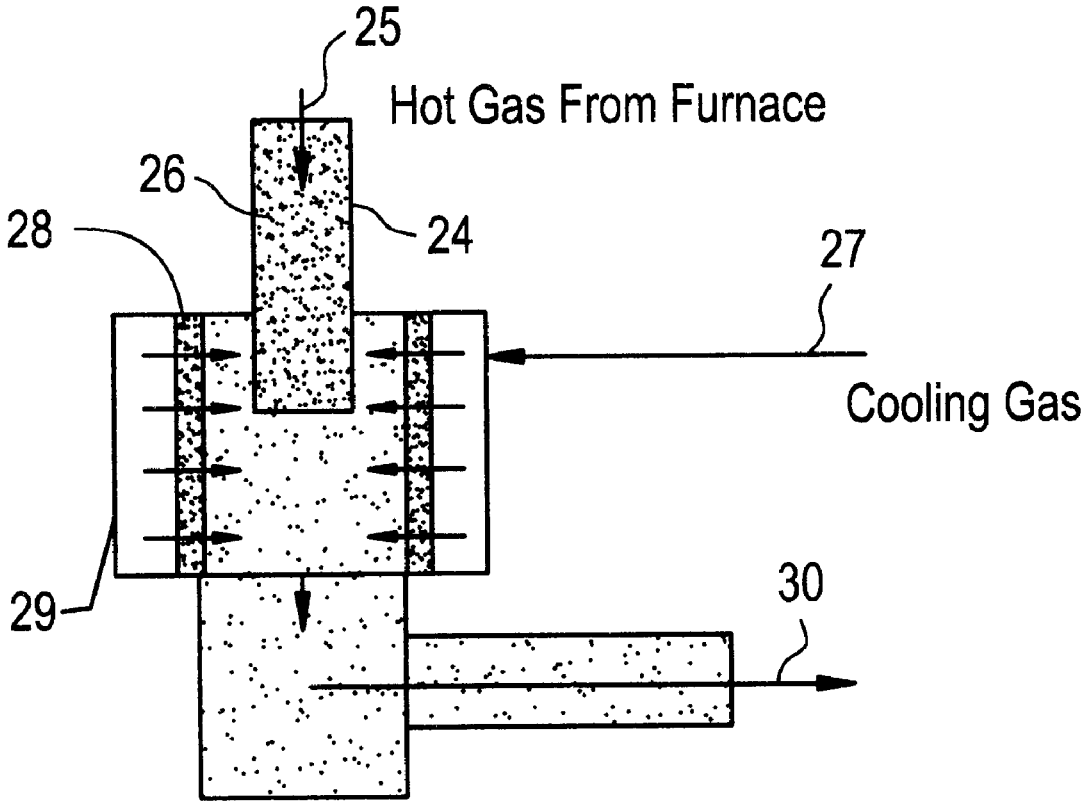
FIG. 4 is a schematic view of a cooler used in the present invention.

The product particles exiting the reactor are cooled in the section (7) to lower temperatures compatible with the filter media used in the product recovery bag or cartridge filter (8). The cooler/diluter (24) of a unique design (shown in FIG. 4) achieves the cooling of the product and the carrier gas (25) as well as prevention of particle loss to walls of the cooling section. The hot gas and product particles from the furnace enter in the center of a cylindrical section (26). Cooling gas (27) enters radially inwards through a concentric porous tube (28) counteracting the tendency of particles to move towards the cooler walls because of a phenomenon known as thermophoresis which may result in loss of up to 20% of the product particles. The cooler/diluter (24) consists of a porous tube (28) jacketed by a solid wall tube (29). Cooling gas (27) is supplied to the jacket and flows inwards from the porous tube walls. After mixing of the hot gas flow from the furnace and the cooling gas the total temperature is reduced to a sufficiently low value typically below 200° C. This "transpiration flow" of the gas keeps the product particles away from the walls.

The product particles (30) are collected in a fabric filter (not shown) in the form of a cake deposited on bags of cartridges made out of a filter media such as Goretex® coated Teflon® felt. The powder product is released from bags into a hopper by a reverse flow caused by a pulsed gas jet or shaking. The particle collector is a conventional structure. Other conventional devices such a cyclone separator or an electrostatic precipitator may be used alone or in addition to the filter. The carrier gas and other reaction products exiting the filter are scrubbed in section (9) to remove contaminants such as oxides of nitrogen, nitric acid vapors and/or hydrogen chloride. The carrier gases and acids can be purified and recycled. The product particle produced by the present invention is not hollow as hollow particles are generally considered undesirable for most uses. The particles of this invention are fully densified, that is, dense throughout their composition.

The following examples will serve to illustrate more detailed aspects of the invention.

EXAMPLE 1

A stable solution of silver and palladium nitrates containing 9% metal at a silver to palladium ratio of 30:70 was prepared by addition of excess nitric acid so as to yield 36% free acid. The solution was atomized by an acoustic device operating at a frequency of 1.7 MHz. The acoustic device consists of a number of piezo electric transducers and circuits made by American Piezo Ceramic (APC) Company for humidification equipment. A carrier gas flow of 20 liters per minute was used. The residence time in the high temperature zone (6) was of the order of 1 second.

Particles were produced with and without the use of the separator. To remove all droplets resulting in palladium particles over 2 micrometers, the cut size should be 1 micrometer, the solution droplet size to be removed is obtained by using $p_s$=1.38 g/cc. and is equal to 4.6 $\mu$m.

The gap width W is obtained by substituting $d_{sc}$=4.2, U by Equation II, $\rho_s$=1.38, and $\mu$=1.8·10E-4 poise.

$$W=2.59\cdot10^{-4}\cdot Q$$

and for the 20 liters per minute flow W=0.33 mm.

The mist exiting the separator was dried to obtain nitrate particles at a temperature of 150° C. and then flowed through the reactor tube maintained at 1400° C. The residence time was 2 seconds. The powder converted to metal and was collected in Teflon coated filter bags maintained at a temperature of 120° C.

Figure 5A:
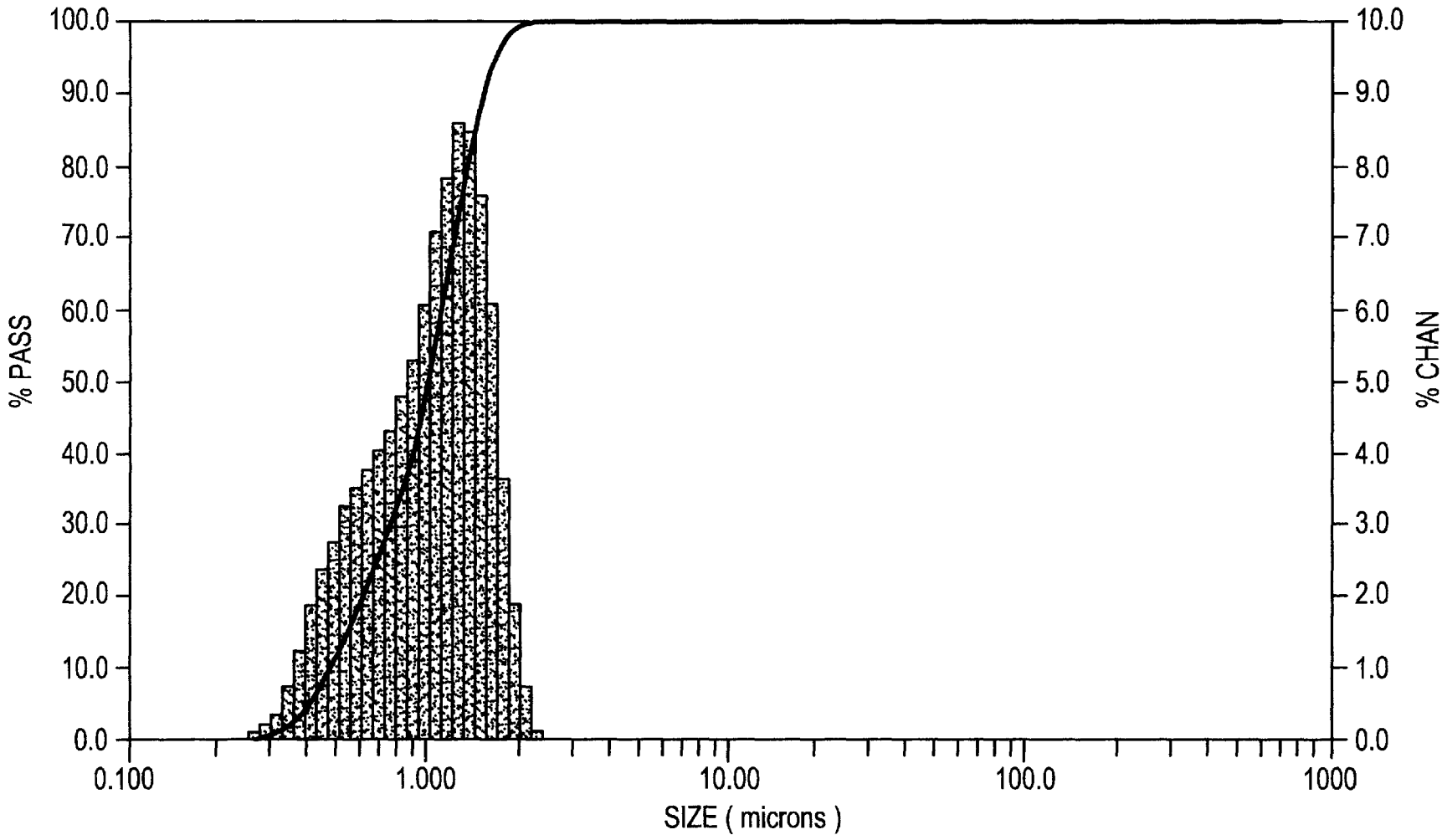
FIG. 5A is a graph of particle size distribution with large droplet separator.
Figure 5B:
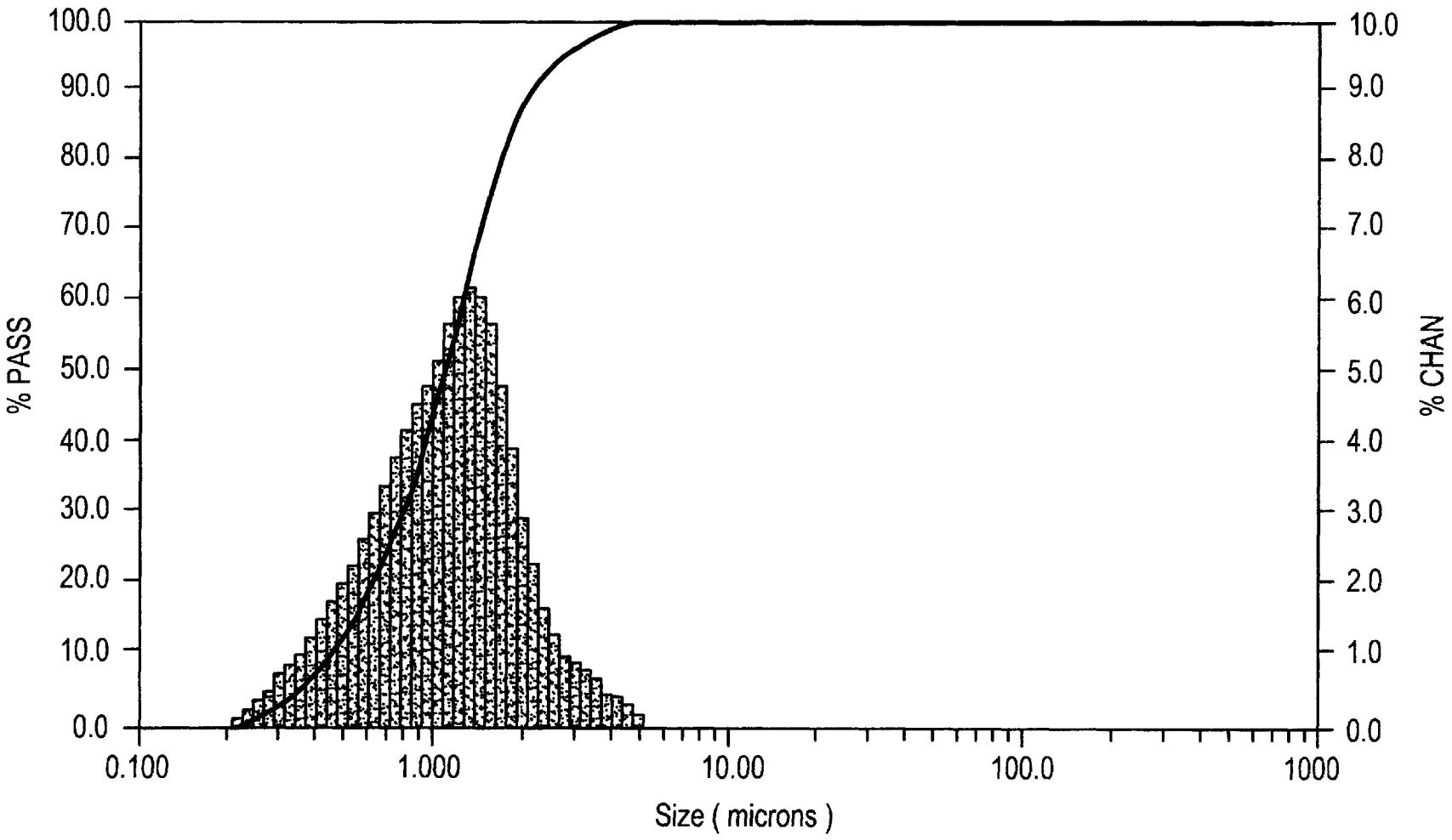
FIG. 5B is a graph of particle size distribution without large droplet separator.

Powder sample was collected with and without the first stage of the selector. Particle size was determined using a Leeds and Northrupp Microtrac instrument. The sample with separator in place contained essentially no particles over 2 micrometers, while a sample without the separator contained several large particles as seen from FIGS. 5A and 5B, respectively.

Figure 6:
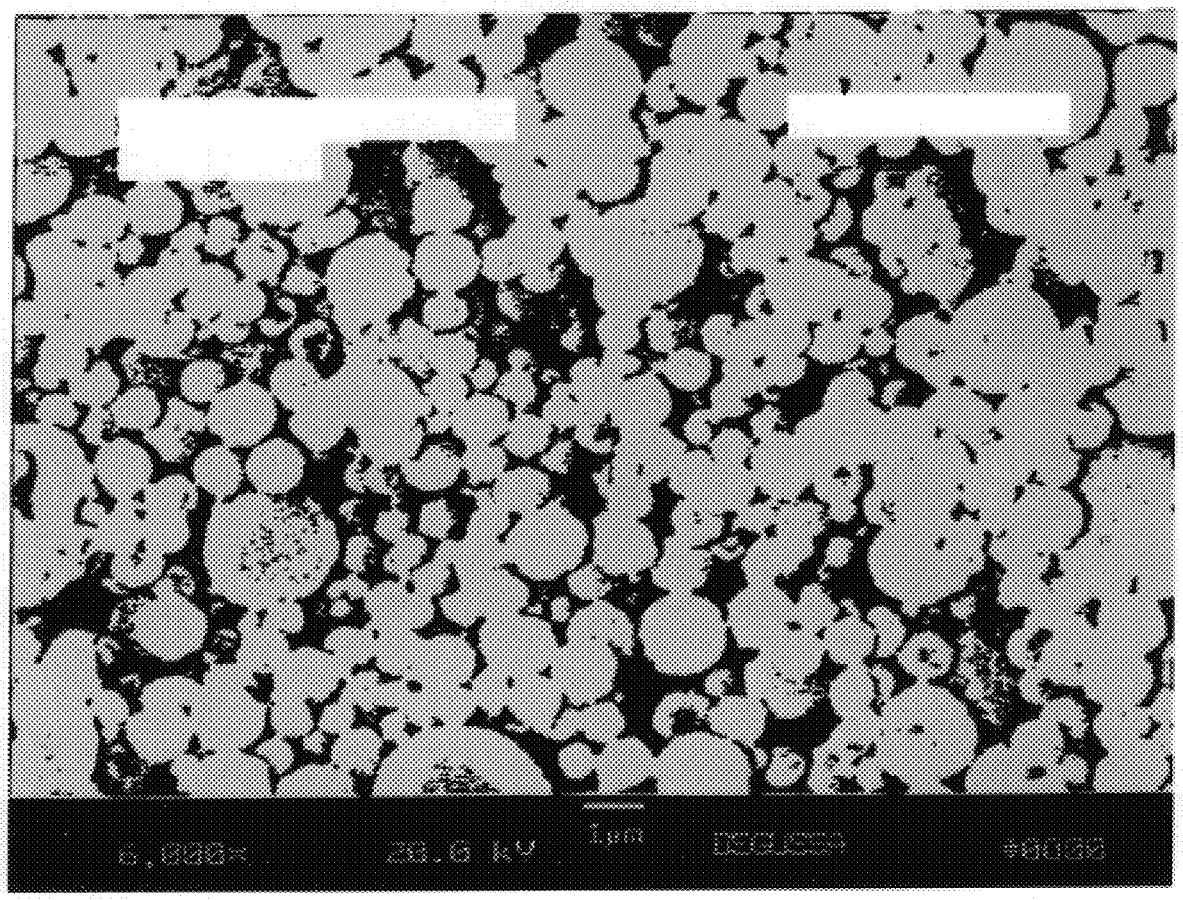
FIG. 6 is an electron photomicrograph of the powder of example 1.
Figure 7:
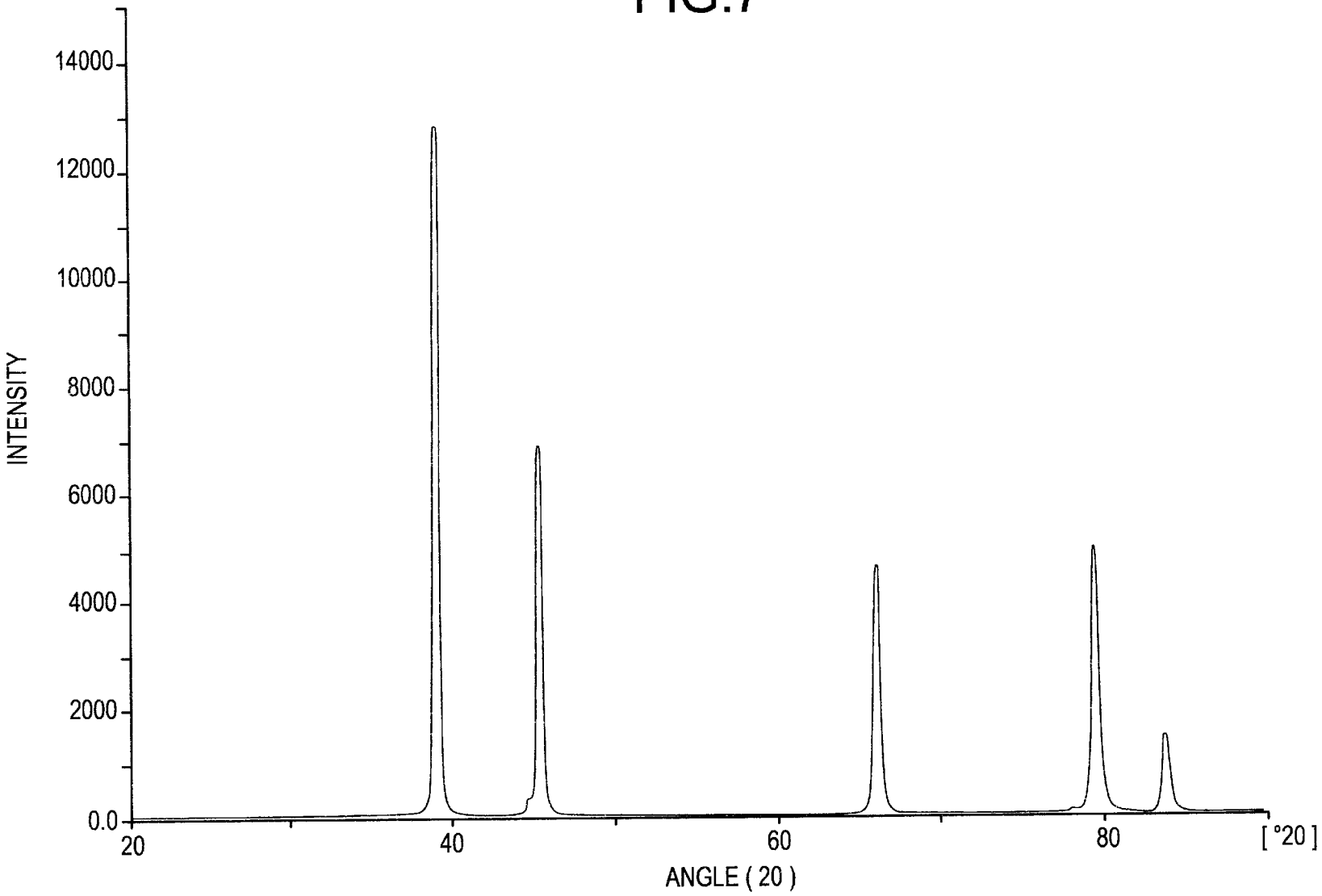
FIG. 7 is an x-ray diffraction pattern of the powder of example 1.

A micrograph of the particles is shown in FIG. 6. An X-ray diffraction spectrum of the powder is shown in FIG. 7 and indicates the particles are true alloys with excellent crystallinity.

EXAMPLE 2

Figure 8A:
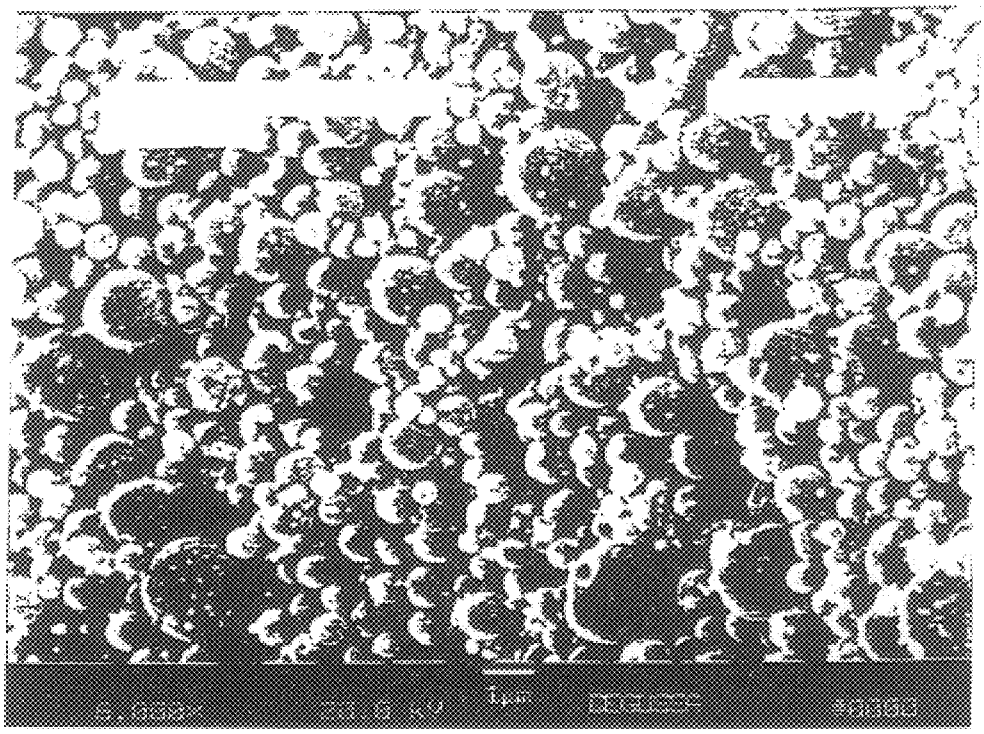
FIG. 8 is an electron photomicrograph of the powder produced with no heat in the dryer.
Figure 8B:
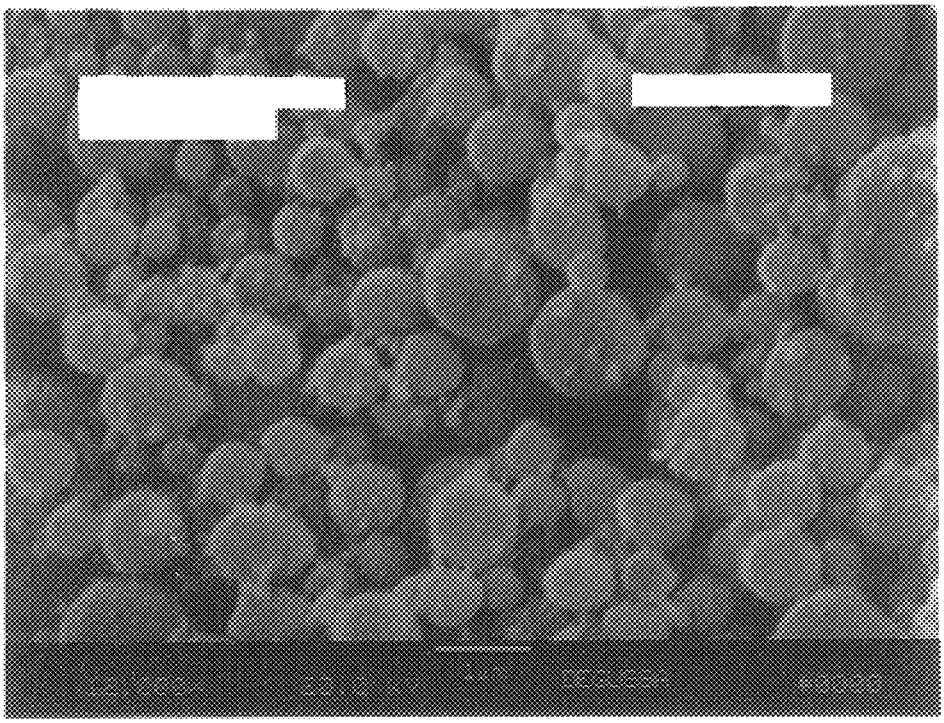
Figure 9:
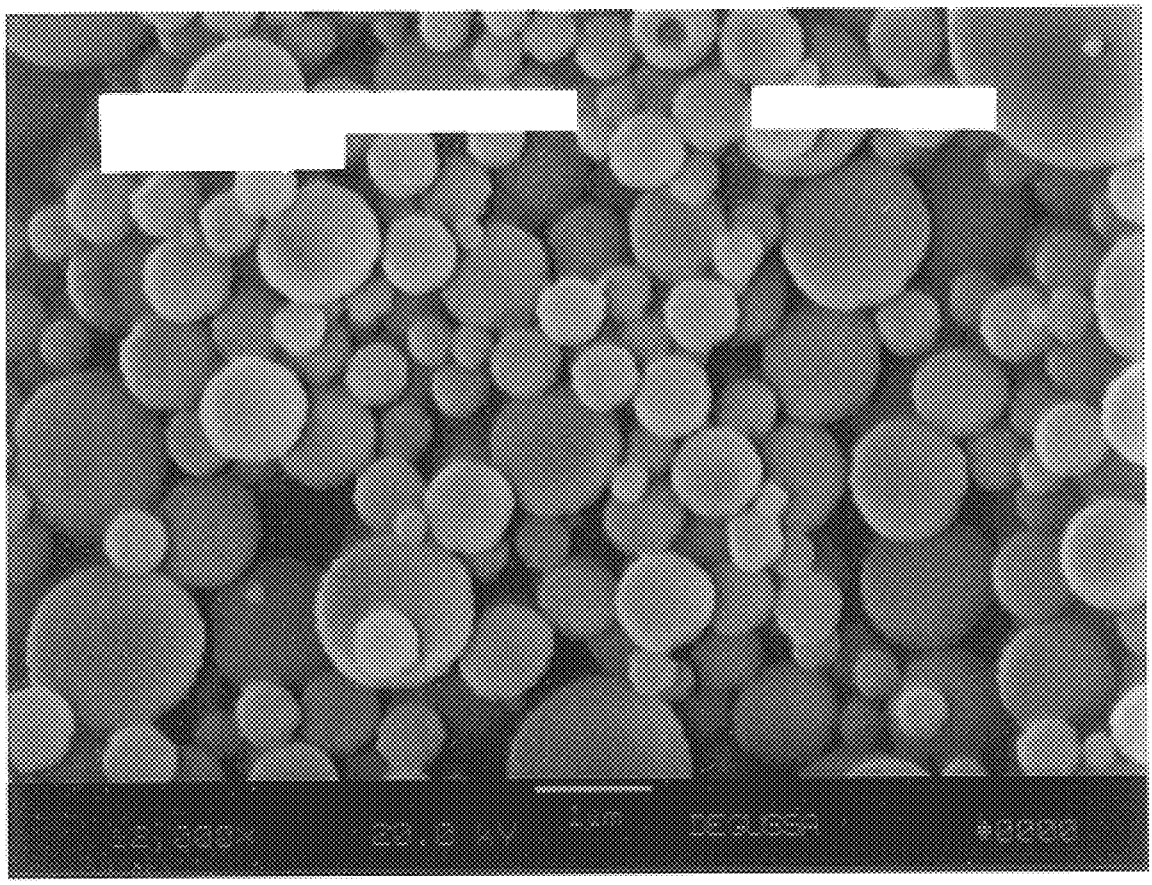
FIG. 9 is an electron photomicrograph of powder produced with heat in the dryer.

An illustration of the effect of controlled drying on powder properties was explored. Starting with a precursor mixed solution of Pd and Ag—nitrates to yield a product with 60% Pd and a 40% Ag content, a mist was generated in section (3) of FIG. 1. The mist passed through the large droplet separator (4) and through the dryer (5). The mist then was subjected to a maximum temperature of 1000° C. to complete product conversion which was then collected in the filter (8). In the first run represented by an electron micrograph of the particles as FIG. 8, the mist was not subjected to heat in the dryer section. As a result, the droplets entering the reactor were wet. In the second run represented by FIG. 9, the droplets were dried in heating section (5) so that the temperature of the mist entering the reactor was at 130° C., at which temperature the mist particles were completely dry. FIG. 8 shows the presence of smaller particles attached to the normally smooth particles, while only the normal particles are seen in FIG. 9. The presence of the smaller particles below 0.3 micrometers is undesirable in several applications as they degrade the electronic properties of the powder and show a tendency to oxidize at lower temperature.

EXAMPLE 3

The following example illustrates the benefits of achieving higher particle concentration in the carrier gases.

The agglomeration of particles results in hard aggregates if the temperature is high and the degree of aggregation is dependent on the self-diffusion coefficient of the product metal and the residence time. The degree of aerosol coagulation resulting in particle contacts is expressed as $$1/n-1/n_o=K\cdot t$$

or $$n_o/n=1+K\cdot t\ n_o$$

where n is the number concentration at time t in #/cc, $n_o$ is the initial number concentration #/cc, K is the Smoluchowski coagulation coefficient cc/s, and t is time in seconds. At a temperature of 1400° C. in the conversion zone, the value of the coagulation coefficient is of the order $10^{-8}$ cc/s. If the initial concentration is of the order $10^8$ #/cc, in one second the concentration will drop by a factor of 2 resulting in a size increase of about 20%, and in 10 seconds the concentration will drop by a factor of 11, resulting in a size increase by a factor of 2.3. Thus, a residence time of 1 second in the high temperature zone will allow higher concentration than possible for a residence time of 10 seconds. This results in significant savings in the energy costs.

Our calculations show that reduction of residence time from 10 seconds utilized by Kodas et al. to 1 second in accordance with the invention will allow a ten-fold permissible increase in droplet number concentration to maintain the same level of agglomeration.

A wide range of metallic powder can be prepared in accordance with this invention. The above examples shows specific materials used in the process of this invention. Other noble metals and base metals can be used with appropriate conditions. Examples are Pt, Ag, Cu, Ni, Co, Ni, Ru and Ta, as well as alloys.

Particle size of a few microns or less is a largely known and proven requirement for multi-layer capacitor electrode materials. Larger particles are known to cause shorting of the parts by penetrating too far into, or through, the dielectric material layer. As far as the lower end of the size range is concerned, there is no lower limit to size, but smaller particles are known to be more reactive and sinter at lower temperatures, so it is common practice to limit the number of very small particles in order to avoid such problems.

Further variations and modifications will become apparent to those skilled in the art from the foregoing and are intended to be encompassed by the claims appended hereto.

What is claimed is:

1. A method for the preparation of finely divided, non-hollow, fully densified metallic nickel and nickel alloy powders comprising:

spraying a liquid aqueous solution containing water and a thermally decomposable nickel precursor compound into a reducing carrier gas to produce a mist of droplets of said solution, said mist being composed of mist droplets of a plurality of sizes, separating said mist into a first portion containing mist droplets larger than a first desired size, and a second portion containing mist droplets smaller than said first desired size, separating said second portion into a third portion and a fourth portion wherein said third portion is larger than a second desired size, said second desired size being smaller than said first desired size, conveying said third portion to a drying zone to remove said water and thereby to form a dry aerosol containing a nickel salt, conveying said dry aerosol to a reaction zone and reacting said dry aerosol in said reaction zone at elevated temperatures sufficient to thermally decompose said nickel salt to metallic, densified powder as substantially spherical shaped particles, cooling said substantially spherical shaped particles, and collecting metallic, substantially spherical shaped particles.

2. The method according to claim 1 wherein said spherical shaped particles have a size range of 0.3 to 2 microns.

3. The method according to claim 1 further comprising adding nitric acid to said liquid solution to thereby enable an increased stable metal precursor concentration.

4. The method according to claim 3 wherein the amount of nitric acid present in said solution is up to 35% by weight based on the total amount of material in the solution.

5. The method according to claim 3 wherein the amount of metal precursor present is up to 30% by weight.

6. The method according to claim 1 wherein said solution is sprayed by an acoustic atomizer, gas driven atomizer or pressure atomizer.

7. The method according to claim 1 further comprising introducing a carrier gas into said spraying zone to thereby form an aerosol.

8. The process according to claim 1 further comprising separating, in a separator having a cup into a first portion and a second portion according to size by the equation:

$$N = \frac{d_s^2 \cdot U \cdot \rho_s}{18 \cdot \mu \cdot W}$$

wherein N is the dimensionless Stokes number, $d_s$ is droplet size in centimeters, $\mu$ is viscosity in poise, $\rho_s$ is solution density in g/cc, U is average velocity in cm/s, and W is the opening in the separator in centimeters equal to $(D_2-D_1)/2$ wherein $D_1$ is the inside diameter of the separator and $D_2$ is the diameter of the cup, and further wherein said first portion has droplets of a larger size than said second portion.

9. The process according to claim 1 wherein all particles over 2.0 micrometers are removed by said separating into said first portion size.

10. The process according to claim 1 wherein most of the particles smaller than 0.3 microns are removed by said separating into said fourth portion.

11. The process according to claim 1 wherein the temperature of the dryer is at 120 to 150° C. at the exit of the drying zone.

12. The process according to claim 1 wherein the temperature of the dryer is maintained a minimum temperature between 50 to 150° C. and above the dew point of the carrier gas.

13. The process according to claim 1 wherein the temperature of the reaction zone ranges up to 1000° C.

* * * * *